US006464111B2

(12) United States Patent
de LaForcade et al.

(10) Patent No.: US 6,464,111 B2
(45) **Date of Patent: *Oct. 15, 2002**

(54) DISPENSER CONTAINING A PRODUCT AND DISPENSING METHOD

(75) Inventors: Vincent de LaForcade, Rambouillet (FR); Frank Lacout, Draveil (FR)

(73) Assignee: L'Oreal, Paris (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/781,247

(22) Filed: Feb. 13, 2001

(65) Prior Publication Data

US 2002/0027146 A1 Mar. 7, 2002

Related U.S. Application Data

(60) Continuation-in-part of application No. 09/361,307, filed on Jul. 27, 1999, now Pat. No. 6,227,141, which is a division of application No. 08/748,918, filed on Nov. 13, 1996, now Pat. No. 5,988,453.

(30) Foreign Application Priority Data

| | | |
|---|---|---|
| Nov. 13, 1995 | (FR) | 95-13412 |
| May 13, 1996 | (FR) | 96-05918 |
| Jul. 31, 1996 | (FR) | 96-09651 |

(51) Int. Cl.[7] ..... B65D 88/54
(52) U.S. Cl. ..... 222/321.9; 222/402.1
(58) Field of Search ..... 222/321.9, 402.1

(56) References Cited

U.S. PATENT DOCUMENTS

| | | | | |
|---|---|---|---|---|
| 2,765,965 A | | 10/1956 | Reswick | |
| 3,099,370 A | | 7/1963 | Hein | |
| 3,122,284 A | | 2/1964 | Miles | |
| 3,233,791 A | | 2/1966 | Miles | |
| 3,327,907 A | | 6/1967 | Meyers | |
| 3,659,395 A | | 5/1972 | Morane et al. | |
| 4,795,063 A | | 1/1989 | Sekiguchi et al. | |
| 5,988,453 A | * | 11/1999 | de Laforcade et al. | 222/321.9 |
| 6,227,417 B1 | * | 5/2001 | de Laforcade et al. | 222/321.9 |

FOREIGN PATENT DOCUMENTS

| | | |
|---|---|---|
| BE | 333 889 | 5/1926 |
| DE | 1 186 808 | 2/1965 |
| EP | 2 009 922 | 12/1970 |
| EP | 0 024 263 | 8/1980 |
| EP | 0 030 990 | 7/1981 |
| EP | 0 248 755 | 12/1987 |
| EP | 0 561 292 | 9/1993 |
| FR | 2 311 723 | 12/1976 |
| JP | 48-24443 | 7/1973 |
| JP | 59-19017 | 2/1984 |
| JP | 62-134880 | 8/1987 |
| JP | 2-150058 | 12/1990 |
| JP | 3-15663 | 2/1991 |
| WO | WO 93/10826 | 6/1993 |

OTHER PUBLICATIONS

"Mini Aerosol," The Coster Group, Oct. 2000.

Thillaud, "Les aerosols Iorgnent les marches des injectables" Emballages Magazine No. 555–Jul.–Aug. 1998.

English translation of Thillaud, "Les aerosols lorgnent les marches des injectables" Emballages Magazine No. 555–Jul.–Aug. 1998.

* cited by examiner

*Primary Examiner*—Philippe Derakshani
(74) *Attorney, Agent, or Firm*—Finnegan, Henderson, Farabow, Garrett & Dunner, L.L.P.

(57) ABSTRACT

A dispenser includes an upper element and a lower element configured to cooperate to form a reservoir and a valve cavity of a valve. In addition to the valve cavity, the valve includes an inlet passage for providing flow from the reservoir to the valve, an outlet passage for providing flow from the valve to a dispensing outlet of the dispenser, and a movable valve member configured to be moved from a closed position to an open position to enable flow through the dispensing outlet. A product is contained in the reservoir, and this product may be chosen from a pharmaceutical composition, a vaccine, a hormone, and a drug. Also, the dispenser may be used in a dispensing method wherein the product is dispensed toward a portion of an individual, such as the mouth, nose, skin, and/or hair.

108 Claims, 11 Drawing Sheets

DISPENSER CONTAINING A PRODUCT AND DISPENSING METHOD

This application is a continuation-in-part (CIP) of U.S. patent application Ser. No. 09/361,307, filed Jul. 27, 1999 (now U.S. Pat. No. 6,227,141), which is a divisional of U.S. patent application Ser. No. 08/748,918, filed Nov. 13, 1996 (now U.S. Pat. No. 5,988,453).

The present invention relates to a dispenser and a method for dispensing a product with the dispenser. The dispenser could be used to dispense a variety of different types of products, such as cosmetic products, vaccines, drugs, and hormones.

Products intended for mass consumption, particularly cosmetic products, are promoted through distribution of free samplers or trial amounts thereof. It is preferred to have the sampler resemble the product on sale as closely as possible, with respect to the formula, the scent, the texture, the galenic form, the packaging, and the outer packaging. For reasons of economy, manufacturers continually seek to produce samplers containing the smallest possible amount of product. Of course, the packaging of cosmetic products in single doses is attractive for travel, as this type of packaging uses very little luggage space.

Although it is known to prepare small-sized product packaging for products contained in pressurized containers, the economic criterion for such packaging is presently not being met. This is because most conventional, small, pressurized containers normally require a certain number of indispensable elements in order to function, namely: a container body, which is a can made of tin plate, aluminum or iron, a valve crimped on the neck of the container body via a dished valve-holder part, and a dispensing means connected to the valve. The container body is typically coated with a lacquer or varnish which sometimes interacts adversely with products intended to be dispensed. In some cases, the metal material used to fashion the container body increases the overall weight of each dispenser.

The containers of most conventional pressurized dispensers are only designed to store products having a pressure of up to 18 to 20 bars. Although this pressure resistance is sufficient for some uses, extremely high temperatures in certain areas sometimes necessitate a dispenser capable of withstanding even greater pressure. For example, dispensers for sun products are often exposed to extremely high temperatures, increasing the risk of possible container explosion or leakage.

Conventional techniques for manufacturing pressurized dispensers do not provide dispensers which are small enough to correspond to the volume of a trial dose, which is approximately 3.5 ml to 8 ml. This is because the work of crimping the metal, i.e. crimping the valve-holder dished part on to the container body, on the one hand, and around the valve, on the other hand, which consists in forcing the metal to adopt a desired configuration, in particular to grip on to the valve, is work which can be done only on parts which are sufficiently large. This manufacturing constraint, therefore, dictates the minimum size of the dished valve-holder part, and, hence, the volume of a can which is necessarily greater than a one-use dose.

Furthermore, the operations for fashioning conventional dispensers are expensive, as is the incorporation of a valve into the can. Manufacturing of conventional aerosol dispensers can be a long process, involving two suppliers, one for the valve and one for the container. These separate parts are often shipped to a location where product is introduced into the container and the valve is mounted to the container before filling the container with a pressurizing gas via the valve. Such a process can make it difficult and expensive to produce a sterile device.

A valve is usually one of the elements which is indispensable to the operation of conventional pressurized containers. In order to solve this problem, use of a can made of a thermoplastic instead of metal has been envisaged. However, this approach is also very expensive since the high internal pressure caused by the gaseous propellant necessitates the use of very thick plastic in order to impart sufficient rigidity.

The crimping of the valve to the neck of the can requires the neck and the valve to have a special shape. It is, therefore, necessary to use a valve which is designed for external crimping, and which is, therefore, more expensive than a standard valve. External crimping has to be carried out on a perfectly even surface, which is to say a surface with no trace of parting line or mould release line. Thus, the cans sometimes must be manufactured by an injection blow-molding technique, which is expensive when a large number of units are produced.

Conventional pressurized devices consist of a container body on which a cap may be fitted; crimped to the neck of this container by means of a dished valve-holder part is a valve; a dispensing means is connected to the valve; the container body and the dished part define a reservoir cavity; the valve consists of a valve body, of a valve-control stem which passes through the valve body, of a seal, and of a return system which presses the valve-control stem against the seal, with all of the above being held in place by the crimping of the valve-holder dished part; and the valve-control stem is surmounted by a push-button. Arranged in the container body are a product to be dispensed and a propulsion means therefor. The propulsion means may be a compressed gas in direct contact with the product in the container body. In this case, a dip member may be fixed to the valve. When it is not desired that the product be in contact with the gas, the gas and the product may be separated by a flexible bag or using a piston. When a flexible bag is used, problems sometimes arise regarding compatibility with the formula and solidity of the material of which the bag is made. The bag is preferably both flexible and leak-tight. When a piston is used for separating the gas from the product, problems may be encountered because of the seal along the contacting surfaces of the piston and of the internal wall of the container body. Furthermore, in both cases, the gas-filler orifice is usually distinct from the one for the formula, i.e. filling with gas often takes place through an orifice situated at the bottom of the container and this orifice is then closed off by a rubber bung. This configuration usually requires repeated operations during manufacture, namely opening the gas-filler orifice, installing the bag or the piston, and fitting the bung. It also may be expensive because of the complexity of the filling process, i.e. requiring filling first with product and then with gas.

EP-A-0561292 discloses dispensing devices using, as propulsion means, a closed-cell cellular material. A gas is held captive in the cells of the cellular material. This document describes a device in which the product is placed in a flexible bottle, inside the container body. The cellular material is placed in this container body in contact with and on the outside of the flexible bottle. The cellular material is connected to a thumb wheel. Before the valve is actuated using a push-button, energy must be stored in the cellular material by actuating a thumb wheel. The gas contained in the cellular material is then placed under mechanical pressure and this pressure is transmitted to the bottle and to its contents. Thus, by actuating the valve, the product can then be dispensed.

However, such a device has numerous drawbacks. For example, this device has a large number of component parts, which component parts require a very fine compatibility (screw threads, leak-tightness) and are, moreover, sophisticated. Consequently, such a device is quite expensive. The storage of energy by mechanical compression of the cellular material takes place in small quantities and the user must turn a thumb wheel in order to store up the energy corresponding to approximately one dose before actuating the push-button. The required two-part action makes the device complicated and not very attractive for consumers with little available time. The bottle in which the product is contained has the shape of a bellows and so, even if it is compressed as much as possible under the action of the cellular material, such a bottle cannot be completely emptied and a low restitution ratio will be obtained.

When energy is stored in the element made of cellular material by turning the thumb wheel, a strong osmotic pressure is created across the wall of the bottle. Thus, the wall of this bottle, subjected to an alternating movement through the mechanical action of the cellular material, is weakened by excessively frequent use. The same problem of compatibility of the product with the wall of the bottle is encountered with this device as is encountered in the case where use is made of a flexible bag for separating a gas from the product. Furthermore, if the user inadvertently exerts too strong an action on the thumb wheel, the cellular material will be subjected to a pressure which causes the cells containing the gas to burst and thereby cause irreversible damage the device. Finally, such a device does not allow the bottle to be filled with product through the valve, pressurizing the cellular material, because this mechanical compression will also result in a bursting of the cells, rendering the device unusable.

The present invention is directed to a dispenser and method of dispensing that optionally obviate one or more of the limitations of the related art. As embodied and broadly described herein, one aspect of the invention includes a dispenser for a product. The dispenser may comprise an upper element and a lower element, the upper element and the lower element being configured to cooperate together so that both the upper element and the lower element form a reservoir and a valve cavity. A product is contained in the reservoir, and the dispenser further comprises a valve including the valve cavity formed by the upper and lower elements, an inlet passage for providing flow of the product from the reservoir to the valve, an outlet passage for providing flow of the product from the valve to a dispensing outlet of the dispenser, and a movable valving member configured to be moved from a closed position to an open position to enable flow of the product through the dispensing outlet.

In another aspect, there is a dispenser comprising a dispensing outlet on an upper portion of the dispenser; an upper element and a lower element, the upper element and the lower element both defining a reservoir; a product contained in the reservoir; and a valve including a movable valving member configured to be moved from a closed position to an open position to enable flow of the product through the dispensing outlet, and a biasing member biasing the valving member toward the closed position, the biasing member being in contact with the lower element.

In a further aspect, the dispenser comprises a reservoir; a product contained in the reservoir; and a valve including a valve cavity, an inlet passage in fluid communication with the reservoir, the inlet passage having a first end in fluid communication with the valve cavity and a second end in a vicinity of a bottom of the reservoir, the inlet passage extending outside of the valve cavity along at least a part of the length of the valve cavity, an outlet passage for providing flow of the product from the valve to a dispensing outlet of the dispenser, and a movable valving member configured to be moved from a closed position to an open position to enable flow of the product through the dispensing outlet.

Yet another aspect is directed to a dispenser comprising: a container body including at least one inner wall and an outer wall defining a reservoir having a generally annular shape extending from a bottom end of the reservoir to a top end of the reservoir; a product contained in the reservoir; and a valve including a valve cavity located in the container body such that the generally annular reservoir surrounds the valve cavity and a top end of the valve cavity is in a vicinity of the top end of the reservoir, an inlet passage for providing flow of the product from the reservoir to the valve, an outlet passage for providing flow of the product from the valve to a dispensing outlet of the dispenser, and a movable valving member configured to be moved from a closed position to an open position to enable flow of the product through the dispensing outlet.

An even further aspect relates to a dispenser comprising: a dispensing outlet on an upper portion of the dispenser, a container body defining a reservoir, the container body including an element defining both a bottom end portion of the reservoir, and a bottom end portion of a valve cavity; a product contained in the reservoir; and a valve including the valve cavity having the bottom portion defined by the element, an inlet passage for providing flow of the product from the reservoir to the valve, an outlet passage for providing flow of the product from the valve to the dispensing outlet, and a movable valving member configured to be moved from a closed position to an open position to enable flow of the product through the dispensing outlet.

There are a variety of different types of products that could be contained in the reservoir. In one embodiment, the product includes at least one pharmaceutical composition. The product could include at least one of a vaccine, a hormone, and a drug. When the product includes a vaccine, the vaccine could be for at least one of flu, rubella, mumps, measles, tuberculosis, tetanus, diphtheria, polio, cholera, plague, rabies, malaria, and leprosy. When the product includes a drug, the drug could be a drug for treating at least one of diabetes, migraine, headache, a lung condition, a bronchial condition, asthma, an allergy, and a cardiovascular condition. The product could include at least one antibiotic.

The product in the reservoir could include at least one sun care product chosen from a sun screen product, a moisturizing product, and an after sun product.

The product could also include at least one cosmetic product. The product could be a product chosen from shaving foam, shaving gel, hair styling mousse, hair spray, and toothpaste.

An additional aspect relates to a method of dispensing a product. In the method, the dispenser is provided and the valving member is moved to the open position to dispense product from the dispense. The dispensed product is directed toward a portion of an individual, such as the mouth, nose, skin, and/or hair.

It is to be understood that both the foregoing general description and the following detailed description are exemplary, and are intended to provide further explanation of the invention as claimed.

The accompanying drawings are included to provide a further understanding of the invention and are incorporated in and constitute a part of this specification. The drawings illustrate embodiments of the invention and, together with the description, serve to explain the principles of the invention. In the drawings, FIG. 1 is a view in longitudinal section of an embodiment of a dispenser of the present invention;

FIGS. 11B, 11C, 12B and 12C show two alternate dispenser embodiments in transverse section, wherein FIGS. 11B and 11C are transverse section views taken along plane II—II of FIGS. 10A and 10B.

Figure 1:
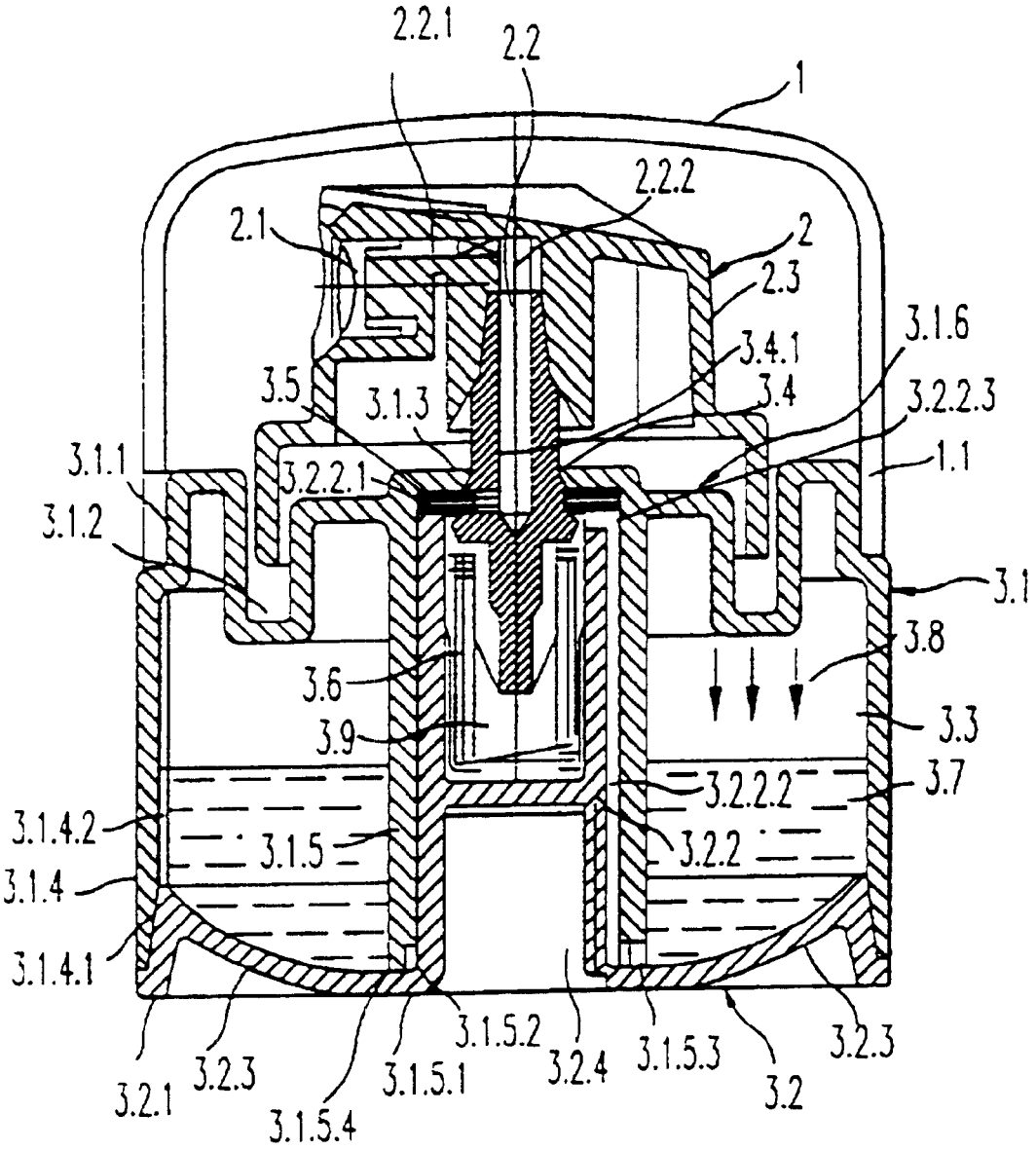

Reference will now be made in detail to embodiments of the invention, examples of which are illustrated in the accompanying drawings. Wherever possible, the same reference numbers are used in the drawings and the description to refer to the same parts, and similar reference numbers are used refer to similar parts.

An embodiment of a dispenser according to the present invention could be in the form of a pressurized container including a lower element, an upper element, and a valve. The upper element optionally has a dish shape. The lower element may form a body of the valve. The lower element and the upper element may be configured to cooperate to form a reservoir and a cavity for the valve. The dispenser may also include a movable valve member, such as a valve stem, and a movable actuator, such as a push-button possibly including a diffusing means. The valve may include a seal and with a return system.

The lower and upper elements may interact in a leak-tight manner at their ends to form the container body. For example, the lower and upper elements may comprise complementary fastening members, for example means which can snap-if together or complementary profiles which, once assembled, are welded together by any means known to those skilled in the art such as, for example, spin welding or bonding. The fastening members may also include complementary screw threads so that the elements can be screwed together in a leak-tight manner.

The lower element may have, on its circumference, first fastening members, and the upper element may comprise an outer skirt having an end with second fastening members which complement the first fastening members; this interaction may define the body of a can. It is also possible to choose a upper element which has on its circumference fastening members, and an lower element comprising an outer skirt which has at its end fastening elements which complement those of the upper element. It is also possible to employ lower and upper elements each comprising an outer skirt, the two skirts comprising complementary fastening members.

The upper and lower element may interact to define a valve cavity. Optionally, the lower element and possibly the upper element each comprise an inner skirt. The inner skirts may fit one inside the other over all or part of their height to define the valve cavity. The inside diameter of the inner skirt of the upper element may be substantially equal to the outside diameter of the inner skirt of the lower element.

The upper surface of the inner skirt of the lower element optionally presses on the valve seal, pressing it against a rim of the upper element, and the seal encircles a passage for a valving member, such as a valve-control stem. The valve, therefore, may be leak-tight.

In an embodiment, a passage is formed between the reservoir and the valve. The inner skirts of the lower and upper elements may each include at least one notch, these notches being associated with a circular chamfer of one or other of the skirts, along the perimeter of the contacting surface of the skirts and possibly with a groove along the entire height of the contacting surface of the skirts, all of these cutouts (e.g., grooves, chamfers, notches) defining the passage for the product, and possibly the gas, between the reservoir and the valve cavity.

The dispensers according to the present invention make it possible to dispense many different types of products. In one embodiment, the product in the reservoir includes at least one pharmaceutical composition. The product could include at least one of a vaccine, a hormone, and a drug. When the product includes a vaccine, the vaccine could be for at least one of flu, rubella, mumps, measles, tuberculosis, tetanus, diphtheria, polio, cholera, plague, rabies, malaria, and leprosy. When the product includes a drug, the drug could be a drug for treating at least one of diabetes, migraine, headache, a lung condition, a bronchial condition, asthma, an allergy, and a cardiovascular condition. The product could include at least one antibiotic.

The product in the reservoir could include at least one sun care product chosen from a sun screen product, a moisturizing product, and an after sun product. Especially when dispensing such products, the dispenser may be configured such that the reservoir is capable of storing a product pressurized up to about 40 bars, or up to about 30 bars.

The product could also include at least one cosmetic product. The product could be a product chosen from shaving foam, shaving gel, hair styling mousse, hair spray, and toothpaste.

The product could also be chosen from lotions, creams, foams and milks. Depending on whether the product to be dispensed is in the form of a continuous phase (i.e., cream or milk) or in a discontinuous form (i.e., foam or spray), the dispenser may be adapted so that a pressurizing gas and the product are separated from one another or, alternatively, mixed in a single reservoir cavity. To separate the gas and the product, the reservoir may include two sealed cavities, one containing the product and the other the gas, with a wall separating these two cavities being capable of transmitting the pressure of the gas from one cavity to the other. The wall between the two cavities may be rigid, for example, a piston, or flexible, for example, a flexible bag, a bellows or an element made of cellular material.

The upper and lower element may be made of thermoplastic. These two elements may be made of the same material or of two different materials which are chemically compatible so that they can be welded together or of two materials which are chemically incompatible and are assembled by screwing, bonding or snap-fitting. The material forming the elements may be chosen from the polyolefin family, such as polypropylene, polyethylene, and ethylene and propylene copolymers, the polyacetyl family, such as polyoxyethylene; it is also possible to employ polyethylene terephthalate and polymethylmethacrylate.

When the dispenser is formed from polymer materials, it may have a lighter weight than some conventional metal dispensers, thereby possibly permitting easier and cheaper transportation. In addition, the polymeric material may be selected such that it does not adversely interact with the product contained in the reservoir. The polymer may contain fillers, such as, for example, silica, glass fibers, and/or carbon fibers. It is also possible to envisage manufacturing the elements from other materials, such as, for example, metal or glass.

The wall thicknesses of the lower and upper elements and especially those of their skirts may be adapted to withstand the pressure of the gaseous propellant.

The movable valving member may be of any type known to those skilled in the art. For example, the valving member could be a valve stem, such as an emerging stem or a female stem. The valving member may be one that moves axially or laterally, the latter type of valving arrangement sometimes being referred to as a tilt valve.

The valve may include a biasing member biasing the valving member toward the closed position. The biasing member may be any type of known return means, such as a spring or any compressible or elastically deformable material that can be housed in the valve cavity.

Optionally, the upper element may comprise a circular channel. This channel may make it possible to use a push-button of standard format which is positioned in the channel. Furthermore, this channel may give greater strength to the upper element.

Optionally, the dispenser may be in the form of aerosol containers, and the dispenser may be configured for sampling one to a few doses of a product, for example, when this type of packaging is desired for a particular form of marketing. For example, the reservoir of the dispenser may be configured to have an inner volume of less than about 10 ml, or a volume ranging from about 3.5 ml to about 8 ml. It should be understood, however, that the dispenser according to the present invention and its use are not in any way limited only to the dispensing of samples, single doses, or a small number of doses. The dispenser may be produced in formats of all sizes, and those skilled in the art would know how to adapt the nature and thickness of the material to give the dispenser sufficient strength.

In one embodiment, there are a set of pressurized containers including several containers as described above, each container including an opening in the bottom of its valve body and a complementary cylindrical stud situated on the cap of the container. This stud and opening allow at least two containers to be secured together by fitting the stud of the first in the opening of the second.

Another embodiment of the dispenser includes an element made of closed-cell cellular material, the element made of cellular material and the product being placed in the reservoir cavity and subjected to a permanent and uniform pressure so that the device dispenses the product when the valve is actuated. As used herein, the term "uniform pressure" means that the pressure is the same at any place inside of the reservoir. Such a device makes it possible to avoid the gas mixing with the product to be dispensed and to avoid leakage of gas. Thus, the duration of use of the device may be prolonged.

Depending on the nature of the cellular material and the size of the element made of cellular material, the pressure inside the device can be adapted to suit the viscosity of the product to be dispensed. Such a device may allow a product to be pressurized without the risk of the product being contaminated by the gas and without contaminating the atmosphere. Furthermore, this device may have only a small number of mechanical components which are in widespread use and may be simple to manufacture; it, therefore, may not be very expensive, and it may be simple to use. The device may be sturdy and have no risk of the cell rupture through inept use. Optionally, the compression means may held inside the device after complete dispensing of the product, and this device can, consequently, be reused several times provided it is refilled with product. With such a device, there may be a savings in the cost of packaging and its possible reprocessing.

The cellular material may include a multitude of cells filled with gas which are included within a deformable matrix, such as, for example, a foam made of polyolefin, of elastomer or of any type of thermoplastic, or of rubber, of Buna, of neoprene, of silicone and/or any other material. The gas may be any gas whatsoever that is compressible or liquefiable at the service pressures, for example, nitrogen or air. When the cellular material is compressed, the cells may also be as well, and, thus, a reserve of energy may be stored in order to pressurize the product. When the valve of the pressurized device is actuated, the cells expand and dispensing of product takes place.

Preferably, the gas present in the cells is contained therein and cannot escape therefrom. Thus, problems of leaks and mixing with the product may be avoided.

In contrast to the device described in EP-A-0561292, the cells of the cellular material may be never subjected to a mechanical pressure, but to a hydraulic pressure; inside the device, and the element made of cellular material may be in direct contact with the product which is subjected to the same pressure as the gas. In this way the risk of the cell rupture may be nonexistent. This element made of cellular material may, therefore, be used a great many times.

When the dispenser includes the element made of cellular material which is used as a pressurizing means, this element may be in a shape which complements that of the reservoir, and is preferably of cylindrical overall shape. The element made of cellular material may be manufactured in any known fashion, such as by extrusion or by cutting from a block of closed-cell cellular material. In order to cut out a cylinder of cellular material, it is preferably compressed before cutting. With this method, after cutting and decompression, an element made of cellular material may be obtained which has slightly concave lateral contours, as described in EP-A-0561292. When such an element is placed in a dispenser according to the present invention, product may become lodged between the concave face and the walls of the container. Thus, a restitution ratio may be obtained which is slightly lower than that which may be obtained with a cylinder which has perfectly straight contours.

A cylinder cut out of cellular material may have open cells on its contours, whereas an extruded cylinder may not.

For this reason, when the cellular material is present, it is preferable to use a cylinder made of cellular material obtained by extrusion.

The device according to the present invention may be used to dispense many types of products, such as those in the form of a solution, emulsion, or of gel: lotions, creams, self-foaming compositions, milks and gels.

Preferably, the element made of cellular material has dimensions (e.g., height and/or diameter) which are larger than those of the reservoir so that when the reservoir cavity is closed, precompression of the element made of cellular material is obtained so as still to have energy available when there is not very much product left in the device.

In one embodiment, the dispenser includes a container body defining a reservoir, a valve, a valve body distinct from the container body, a dispensing means connected to the valve, and a pressurizing means in the form of an element made of closed-cell cellular material, the element made of cellular material and the product being placed in the reservoir cavity and subjected to a permanent and uniform pressure so that the device dispenses the product when the valve is actuated. According to this alternative form, the valve may be crimped to the neck of the container, in a known way, via a dished valve-holder part, the container body and the dished part defining the reservoir cavity.

The present device may include a valve made of elastomeric material including snap-fitting means able to interact with the neck of the container body as described in French Patent Application No. 95/14175.

Preferably, the device according to this alternative form is equipped with a push-button connected to the valve. This push-button may include a diffusing means chosen from, for example, a nozzle, a mesh, or a porous dome.

The device according to this alternative form may include a dip tube connected to the valve body.

Another alternative form of the dispenser includes upper and lower elements configured to cooperate to form a reservoir and a valve cavity, and the propulsion means consisting of an element made of cellular material.

According to this alternative form, the valve body passes through the reservoir over its entire height, and constitutes a dip member. When the device has a dip member, the piece of cellular material has, through its entire height, a cylindrical central orifice in which the dip member is housed.

When the device does not have a dip member, there may be a central orifice in the element made of cellular material. When the device is assembled, the element made of cellular material is inserted into the reservoir. The element made of cellular material may be generally of a height greater than or equal to the height of the reservoir. When the valve is placed at the top of the reservoir cavity, for example when the valve is crimped to the top of the container body whose walls define the reservoir cavity, with the aid of a valve-holder dished part, the valve may exert a mechanical compression on the top of the element made of cellular material. The cells subjected to compression may burst, and the element made of cellular material may be deformed at its upper part. Product can then become lodged in this deformation. Gas may be diffused into the reservoir cavity and mix with the product. To avoid these drawbacks, there may be formed in the element made of cellular material, a central orifice in which the valve can be inserted even when the device has no dip member.

FIG. 1 shows an embodiment of a dispenser in the form of a pressurized container having a cylindrical overall shape. The dispenser includes a cap 1 snap-fastened onto an upper element 3.1 in the form of a dish-shaped part. This dished part interacts with a lower element 3.2 to form, on the one hand, an annular reservoir cavity 3.3 containing the product 3.7 and a gaseous propellant 3.8, and, on the other hand, a valve cavity 3.9. Inside the valve cavity 3.9, there are: a movable valving member in the form of an emerging valve-control stem 3.4, a seal 3.5, and a spring 3.6. The lower element 3.2 includes a valve body and this structure in combination with the stem 3.4, seal 3.5, and spring 3.6 form a valve for the embodiment shown in FIG. 1. The emerging stem 3.4 comprises an outlet orifice 3.4.1 and interacts with a movable actuator in the form of a push-button 2.

In the embodiment of FIG. 1, the seal 3.5 is a component which is independent of the upper element 3.1, but according to an alternative form of the present invention, the seal may be a component integral with the upper plate 3.1.6 of the upper element, made by twin injection of an elastomeric material when the upper element is manufactured, with the same position as the independent seal 3.5.

The push-button includes a nozzle 2.1 and a central duct 2.2 including a radial part 2.2.1 and an axial part 2.2.2, the nozzle 2.1 being mounted at the end of the radial part, the emerging stem 3.4 being positioned in the axial part of the duct. The cylindrical external skirt 2.3 of the push-button 2 may be elbowed and pass into a circular channel 3.1.2 on the upper plate 3.1.6 of the upper element 3.1.

Further, at the center of its upper plate 3.1.6, the upper element 3.1 has an orifice 3.1.3 through which the emerging stem 3.4 passes, an outer skirt 3.1.4 and an inner skirt 3.1.5, which are coaxial, the plate 3.1.6 being orientated substantially at right angles to these skirts. In addition, it is possible to add to the internal face of the outer skirt 3.1.4, one or more ribs 3.1.4.2 with the purpose of reinforcing the strength of the wall 3.1.4 with regard to the internal pressure.

The outer skirt 3.1.4 in its bottom part has a profile 3.1.4.1, here in the shape of a chamfer, which is capable of accommodating a complementary profile 3.2.1, which is also chamfered, coming from the lower element 3.2; these two profiles are welded.

The bottom of the lower element 3.2 includes a rounded annular profile 3.2.3 and a cylindrical cavity 3.2.4.

The valve cavity 3.9 may advantageously be chosen to have a height suitable to allow a spring 3.6 of standard format to be housed.

The cavity 3.2.4 complements the cavity 3.9 of the valve, it corresponds to the difference in height between the cavity 3.3 and the valve cavity 3.9.

Figure 9B:
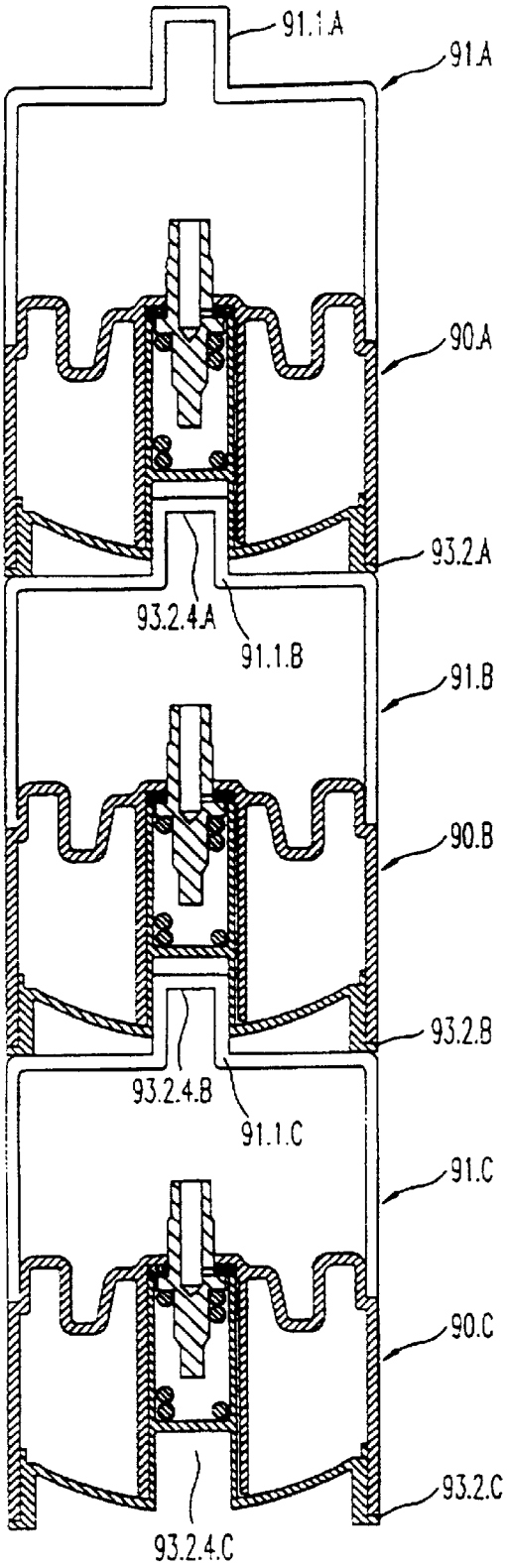
FIGS. 9A and 9B are views in longitudinal section showing an alternative embodiment of a dispenser and of a set of these dispensers assembled together (the actuators (e.g., push-buttons) are not shown in order to make the figures easier to understand)
Figure 9A:
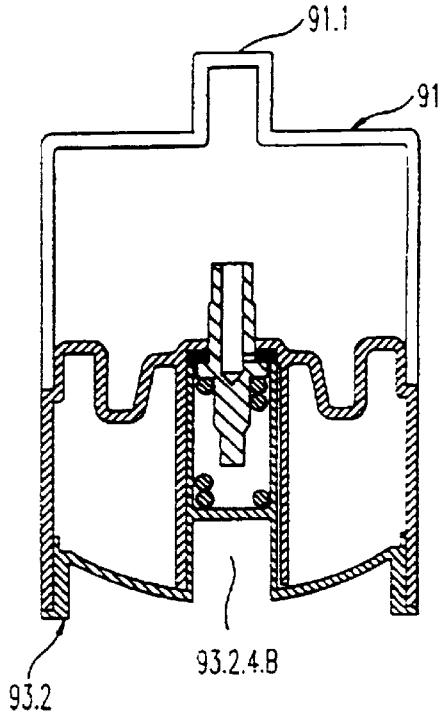

A complementary cylindrical stud situated on the cap 1 of a second container according to the invention fits into the cylindrical cavity 3.2.4 in order to secure at least two containers together (see FIGS. 9A and 9B). Such a possibility for the assembly of the containers according to the invention is particularly judicious, because it makes the storing and handling of these containers easier and allows them to be stowed away in luggage, for example, taking up a minimum amount of space and without the risk of them becoming scattered. The containers may contain the same product or products of different natures.

The inner skirt 3.1.5 of the upper element has an inside diameter which corresponds substantially to that of the seal 3.5 and a height which is substantially identical to that of the cavity 3.3. The lower surface 3.1.5.4 of the inner skirt of the upper element is welded to the bottom of the lower element. This weld gives the container as a whole greater strength, particularly greater ability to withstand the pressure of the gas. This welding may be achieved by any means known to those skilled in the art, such as ultrasonic welding, mirror welding, spin welding, bonding. Situated on the internal periphery of the skirt 3.1.5 is a chamfer 3.1.5.2. Furthermore, a notch 3.1.5.3 is made in the internal periphery of the bottom of the skirt 3.1.5; this notch breaks up the continuity of the weld between the internal skirt and the lower element.

The profile 3.2.3 is designed so that the bottom of the lower element has a concave face pointing towards the inside of the cavity 3.3. Thus, when there is little product left, this becomes placed around the internal skirt of the lower element and can be dispensed. This profile makes it possible for the product to be used up better by comparison with a container equipped with a flat bottom. Such a profile also gives the container as a whole a greater ability to withstand pressure.

The lower element 3.2 has the profile 3.2.1 which complements the one already described 3.1.4.1 on its circumference; this profile allows the lower and upper elements to be centered during assembly and is welded to the part 3.1.4.1 of the upper element. According to an alternative form of the container of the invention, the profiles 3.2.1 and 3.1.4.1 of the lower and upper elements, respectively, may have complementary screw threads so that these elements may be screwed together. The two profiles 3.2.1 and 3.1.4.1 can also be designed so that they snap-fit together. The lower element has an inner skirt 3.2.2, the outside diameter of which is substantially equal to the inside diameter of the inner skirt 3.1.5 of the upper element and these two elements are welded. Placed on the upper edge of this skirt 3.2.2 is a sealing ring 3.2.2.1. A groove 3.2.2.2 is provided on the external lateral face of this skirt 3.2.2 over its entire height, and a notch 3.2.2.3 is situated on the upper edge of this skirt. According to an alternative form of the present invention, the groove 3.2.2.2 may just as easily be cut in the interior face of the inner skirt of the upper element.

To assemble the pressurized container shown in FIG. 1, the spring 3.6 was first of all assembled around the emerging stem 3.4, then the seal 3.5 was placed in the space defined by the inner skirt of the lower element; next, the upper element 3.1 is positioned and welded to the lower element body 3.2 at the skirt ends. The pressurized container obtained is preferably leak-tight and withstands pressure. In particular, the weld between the inner skirt of the upper element and the bottom of the lower element as well as the circular channel on the dished part may strengthen the can.

The parts forming the valve and reservoir of the dispenser may be assembled (and optionally also molded when made of plastic) at a first location in a generally clean and generally sterile environment. This assembly may then be shipped to a second location where the dispenser can be filled with a product, such as a cosmetic product or a pharmaceutical product, while maintaining general cleanliness and sterility of the interior of the reservoir and the product contained therein.

The pressurized container may be filled via the valve, for example, by depressing the emerging stem 3.4 so that the orifice 3.4.1 clears the seal. The product, under pressure, fills the first cavity 3.9 defined by the inner skirt of the lower element, passes through the notch 3.2.2.3, runs down along the groove 3.2.2.2, via the chamfer 3.1.5.2 then via the notch 3.1.5.3 and fills the cavity 3.3. The push-button and the cap may then be fitted on the emerging stem and on the upper element, respectively.

To use the dispenser, the actuator (e.g., push-button) is depressed and the product follows the reverse path to the one described for filling the can and is atomized as it passes through the nozzle 2.1. This embodiment is designed for head-up use.

When the product is a pharmaceutical product, cosmetic product or any other product intended to be dispensed to an individual, the product could be dispensed toward a portion of an individual, such as the mouth, nose, skin, and/or hair, by orienting the dispenser with respect to the portion so that the outlet of the dispenser sprays the product toward the portion of the individual.

In an alternative form of the dispenser of FIG. 1, provision may be made for the notch 3.1.5.3 to be placed at the same level as the notch 3.2.2.3, the chamfer 3.1.5.2 also being situated level with the upper edge of the inner skirt of the lower element. According to this alternative form, no groove 3.2.2.2 is provided in the internal skirt 3.2.2 of the lower element. Such a container is used head down.

Optionally, the dispenser according to FIG. I may be intended for the dispensing of lacquer, hair lotion, and/or scent.

Figure 2:
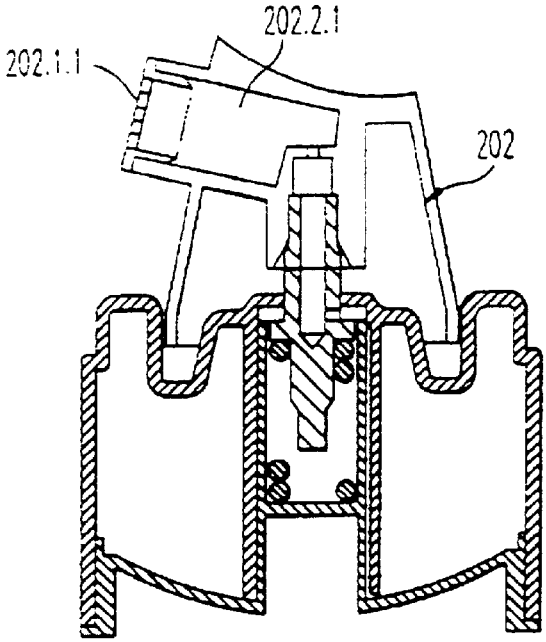
FIGS. 2 and 3 are views in longitudinal section of dispenser embodiments including dispensing means which differ from those of FIG. 1.

The dispenser represented in FIG. 2 can be distinguished from that represented in FIG. 1 by the presence of a mesh 202.1.1 at the outlet of the radial duct 202.2.1 belonging to the push-button actuator 202, in place of the nozzle 2.1 of FIG. 1. This mesh is more particularly designed for dispensing products in the form of foams, such as shaving foam or hair styling mousse.

Figure 3:
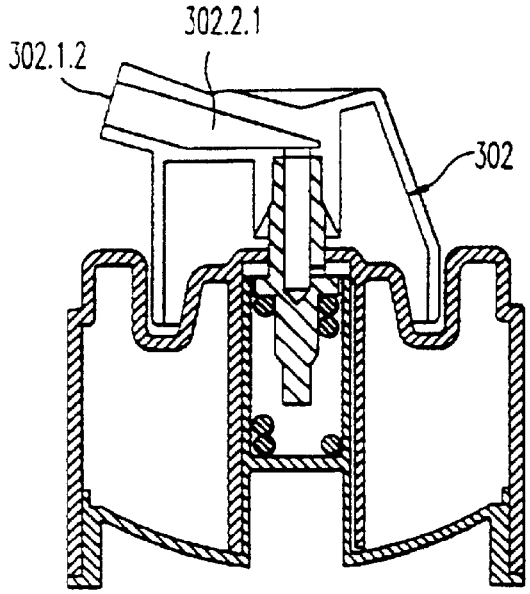

The dispenser represented in FIG. 3 can be distinguished from the two preceding containers by the absence of diffusing means at the end 302.1.2 of the radial duct 302.2.1 of the push-button actuator 302. This dispenser is intended to deliver a toothpaste or a polish.

The two diffusing means of FIGS. 1 and 2 are merely examples of possible diffusing means. Any other dispensing means known to those skilled in the art, such as a porous dome like the one described in FR-A-2713060 for example, may be fitted to the dispensers of the present invention.

Figure 4:
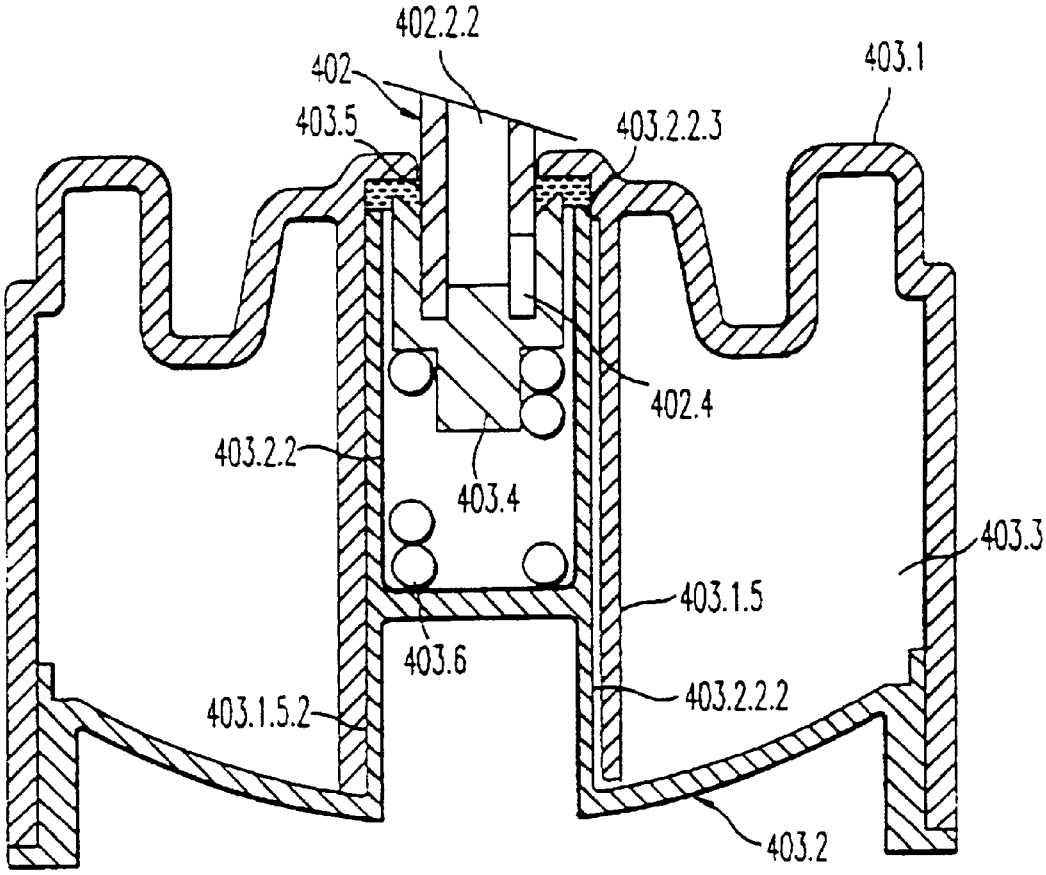
FIG. 4 is a view in longitudinal section of another embodiment of a dispenser according to the present invention, equipped with a female valve.

The dispenser represented in FIG. 4 includes an upper element 403.1, a lower element 403.2, a spring 403.6, a seal 403.5 and a valve-control stem 403.4. For purposes of simplification, the cap is not represented, and the end of the push-button actuator 402 interacting with the valve-control stem is simply represented. This dispenser can be distinguished from those represented in the preceding figures: by its valve-control stem 403.4 which is of the female type, and in which the end of the push-button 402 will be inserted; and by the fact that the groove 403.2.2.2 is cut from the interior face of the internal skirt 403.1.5 of the upper element and not from the internal skirt 403.2.2 of the lower element.

When a user exerts pressure on the stem 403.4, via the push-button 402, the end of the duct 402.2.2 of the push-button 402 pushes the valve stem 403.2 downwards, which breaks the seal between the valve stem 403.4 and the seal 403.5. The product can then pass from the cavity 403.3 to the dispensing duct 402.2.2 via the duct 403.2.2.2, the notch 403.2.2.3, a slot 402.4 made at the end of the pushbutton 402 and the chamfer 403.1.5.2. As far as the user is concerned, the operation of this dispenser is the same as that of the preceding dispensers.

Figure 5:
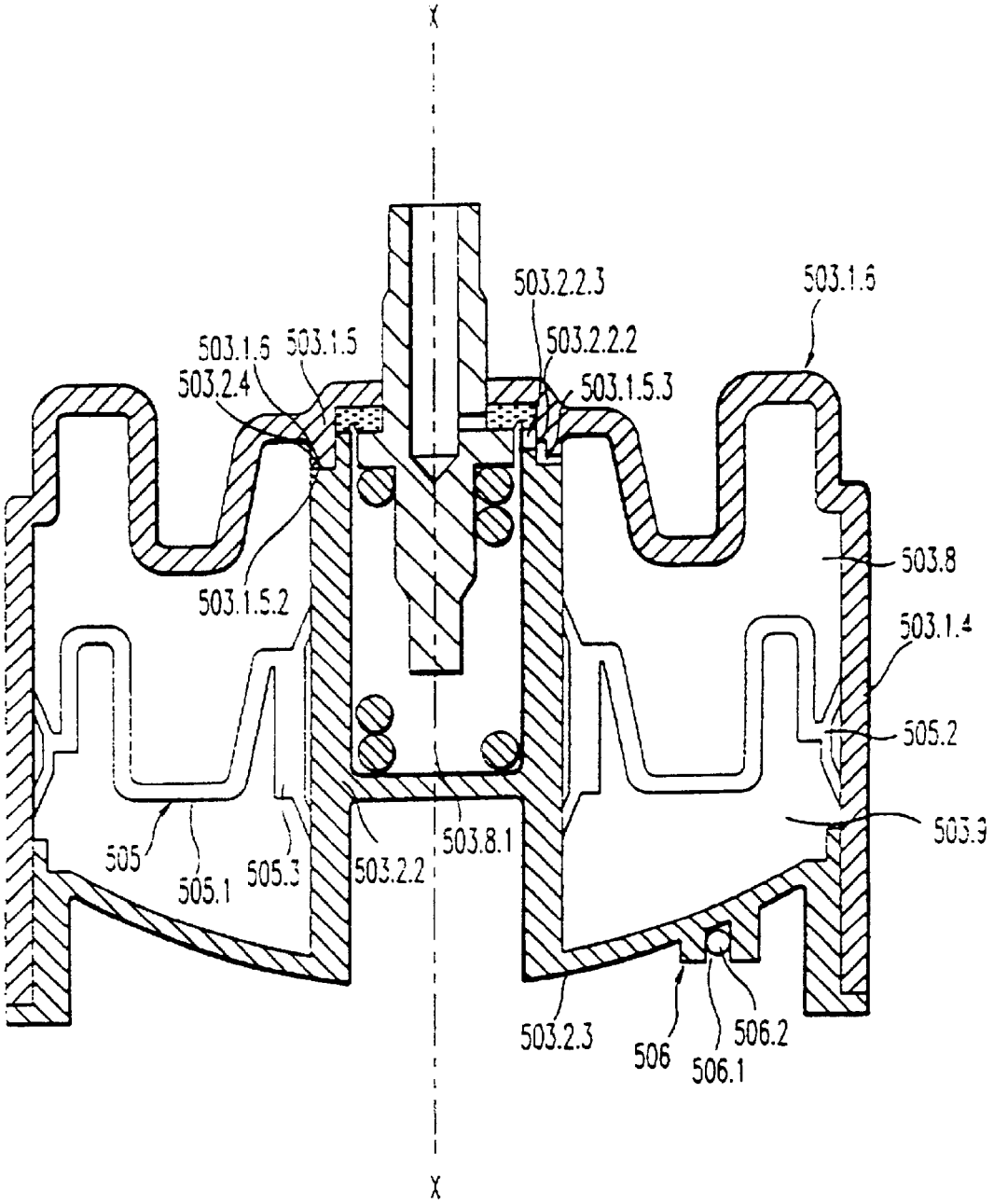
FIGS. 5 and 6 are views in longitudinal section of embodiments of dispensers according to the present invention, wherein the reservoir cavity is divided in two by a piston.

The dispenser represented in FIG. 5 can be distinguished from the one in FIG. 1 by the relative arrangement of the internal skirts of the upper element 503.1.5 and of the lower element 503.2.2, and by the presence of a piston 505 and a ball-type filling orifice 506. In this dispenser, the internal skirt of the lower element 503.2.2 has a height substantially equivalent to that of the cavity 503.8.1 of the valve and has a shoulder 503.1.6 on its upper edge, against which shoulder the lower edge 503.2.4 of the internal skirt 503.1.5 of the upper element comes to rest. A passage able to contain the product is formed between the cavity 503.8 and the valve cavity 503.8.1 by cutting out a notch 503.2.2.3 in the internal skirt of the lower element and, facing this notch, cutting a notch 503.1.5.3, a chamfer 503.1.5.2 and a groove 503.2.2.2 in the internal skirt of the upper element.

The annular piston 505 separates the reservoir cavity into two cavities: one, 503.8 capable of containing the product, and the other, 503.9, capable of containing the gas. The piston 505 is equipped at its ends with means 505.2 and 505.3 of the sealing lip type allowing it to be positioned in a leak-tight manner on the external skirt 503.1.4 of the upper element and on the internal skirt 503.2.2 of the lower element, respectively. This means prevents the gas and product from mixing. The piston can move and travel along a vertical axis (X—X) passing through the valve-control stem, while remaining positioned against the two skirts.

The piston 505 is further equipped with a profile 505.1 allowing it to match the internal wall of the upper plate 503.1.6 of the upper element so that the cavity 503.8 can be emptied as completely as possible as this piston moves towards the upper part of the dispenser, as it is used, under the pressure of the gas.

The ball orifice 506 includes a cylindrical orifice 506.1 and a ball 506.2, with a diameter larger than that of the orifice so that when the ball is pushed forcibly into the orifice, it closes it in a leak-tight manner. This ball orifice 506 is placed in the bottom 503.2.3 of the lower element.

Before the dispenser of FIG. 5 is filled, the piston is pressed against the lower element. The product is introduced into the cavity 503.8 in the same way as in the container of FIG. 1 (via the valve-control stem). The gas is introduced via the orifice 506.1 then the latter is closed by the ball 506.2 which is pushed in forcibly.

Figure 6:
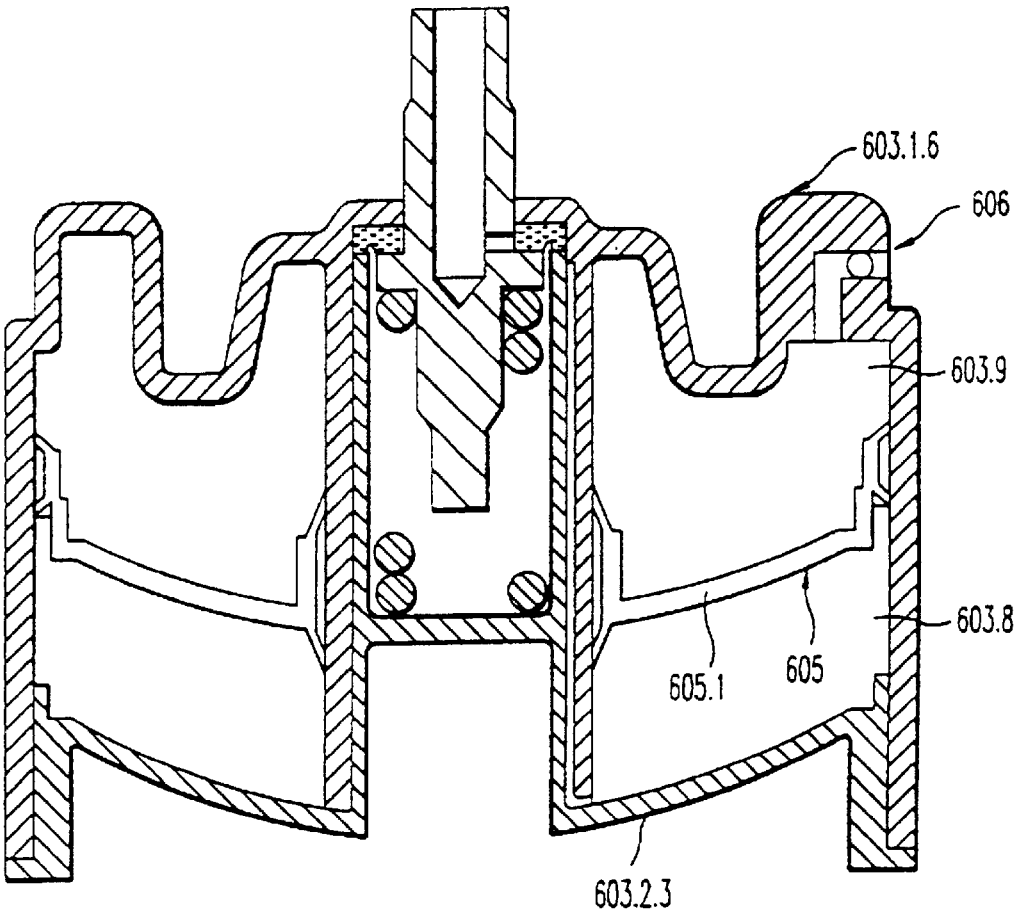

The dispenser represented in FIG. 6 can be distinguished from that of FIG. 1 by the presence of an annular piston 605 in the reservoir cavity, which partitions the latter into a product cavity 603.8 in its lower part and a cavity 603.9 able to contain the gas in its upper part. The arrangement of the piston is the inverse of that of FIG. 5: the profile 605.1 of the piston is designed to match the Internal profile 603.2.3 of the bottom 603.2.3 of the lower element. The ball orifice 606 is situated in the upper part of the upper element, so as to allow the cavity 603.9 to be filled with gas. During assembly, the piston 605 is placed against the bottom 603.2.3 of the lower element, then the product is introduced into the cavity 603.8 via the valve, as in the other dispensers and the compressed gas is introduced via the ball orifice 606 before this orifice is closed.

Figure 7:
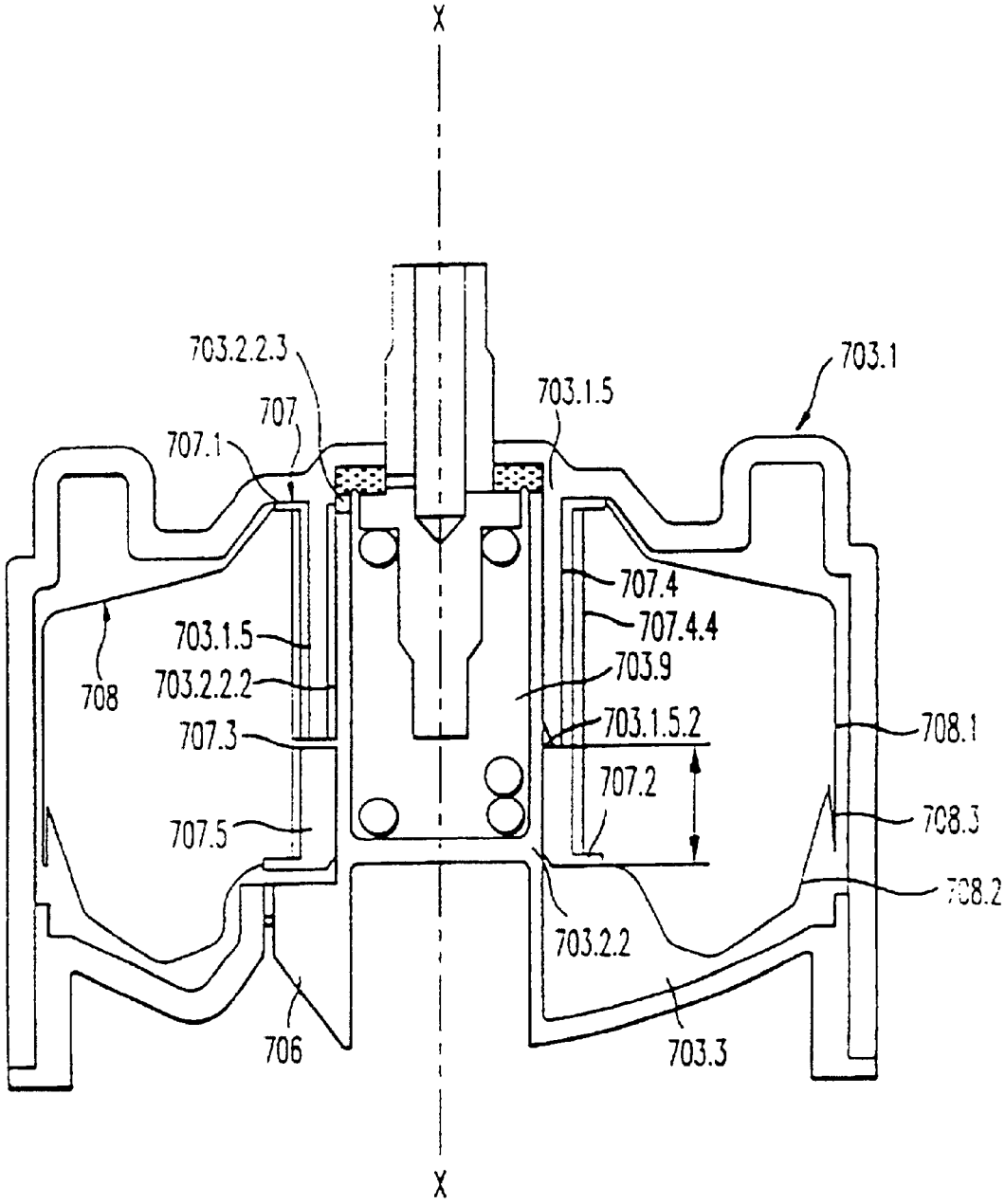
FIG. 7 is a view in longitudinal section of an embodiment of a dispenser, wherein the reservoir cavity is divided in two by a bag mounted on a spool.

The dispenser represented in FIG. 7 can be distinguished from that of FIG. 1 by the presence of a deformable bag 708 fixed to a cylindrical spool 707 in the reservoir cavity 703.3, with the same axis X—X as the internal skirt of the lower element 703.2.2 and of the upper element 703.1.5, by the altered arrangement of the skirt 703.1.5 of the upper element 703.1 and by the presence of a ball orifice 706 in the lower element.

The skirt 703.1.5 of the lower element has a height which is less than that of the reservoir cavity 703.3. The cylindrical spool 707 in its lower part 707.5 has an inside diameter substantially equal to the outside diameter of the internal skirt 703.2.2 of the lower element, so that the internal skirt of the lower element is placed inside the spool and is in sealed contact therewith over its entire lower part 707.5. Over the rest of its height 707.4, the spool has an inside diameter equal to the outside diameter of the internal skirt 703.1.5 of the upper element so that in its upper part 707.4, the spool traps in sealed manner the internal skirt 703.1.5 of the upper element, itself slipped around the skirt 703.2.2 of the lower element. In its upper and lower parts, the spool 707 has two annular regions of welding 707.1 and 707.2 respectively. On its outer surface, the spool 707 has anti-trapping channels 707.4.4. These channels make it possible to avoid some of the product remaining blocked in a part of the bag when the latter is emptying and becoming pressed against the spool.

The bag 708 includes 2 parallel sheets 708.1 and 708.2 welded together by an annular weld 708.3, and welded to the spool by the regions of welding 707.1 and 707.2. The bag/spool assembly forms a sealed cavity in communication with the valve cavity 703.9 via the opening 707.3, and the chamfer 703.1.5.2 of the spool 707, the groove 703.2.2.2 cut along the entire height of the internal skirt 703.1.5 of the upper element, and the notch 703.2.2.3 on the upper edge of the internal skirt of the lower element.

During assembly, the bag 708 is welded to the spool 707, and the assembly is slipped over the internal skirt of the upper element and then the lower element is positioned and welded to the upper element.

The valve makes it possible, after the entire dispenser has been assembled, to produce a vacuum in the bag 708, then to fill it with product. The gas is introduced into the reservoir cavity 703.3 via the ball orifice 706, before this is closed.

Figure 8A:
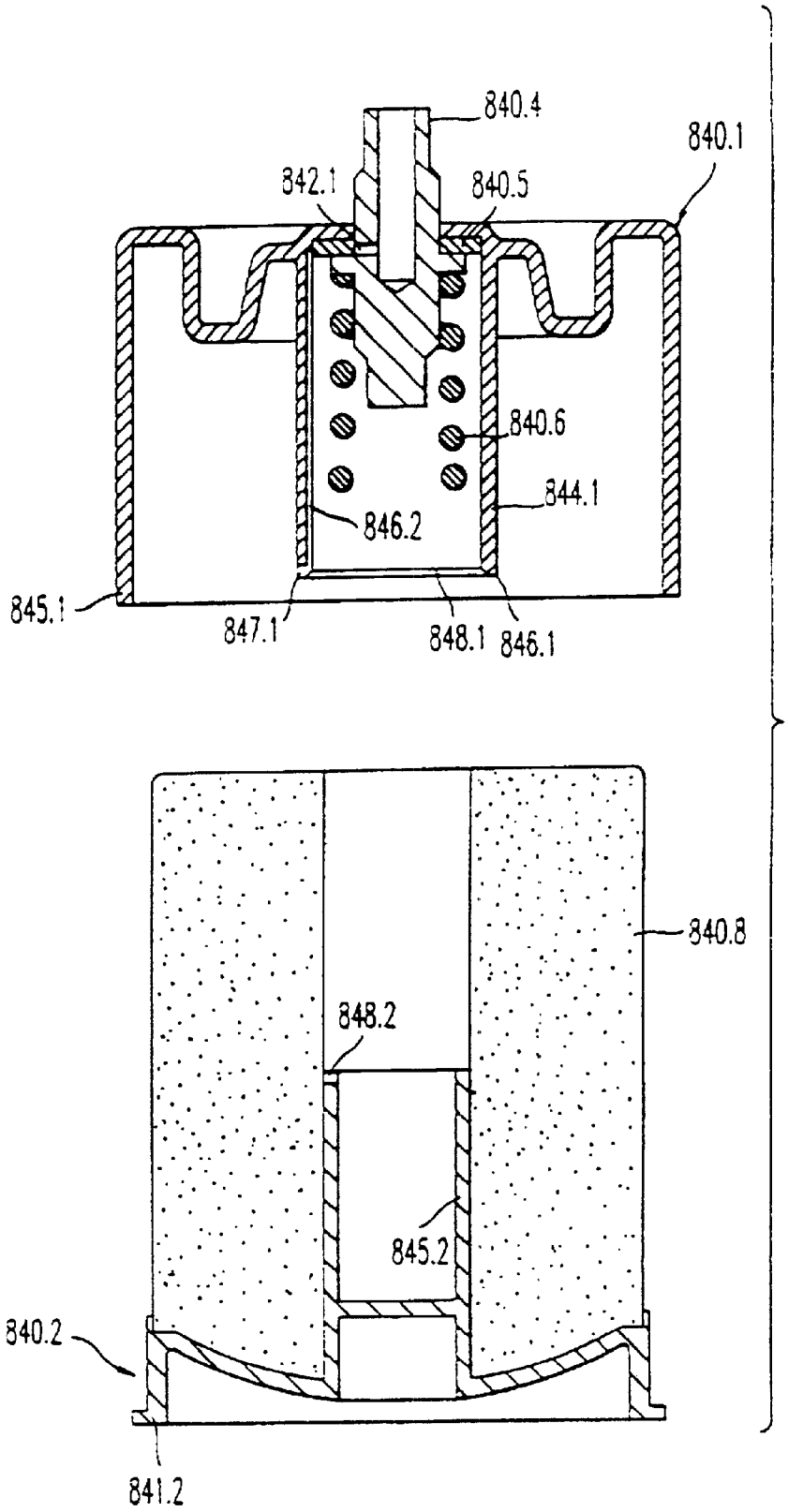
FIGS. 8A to 8C are views in longitudinal section of a dispenser embodiment wherein the reservoir cavity contains a ring of cellular foam (for simplicity, neither an actuator (e.g., a push-button) nor a cap are shown in FIGS. 5 to 8C)
Figure 8B:
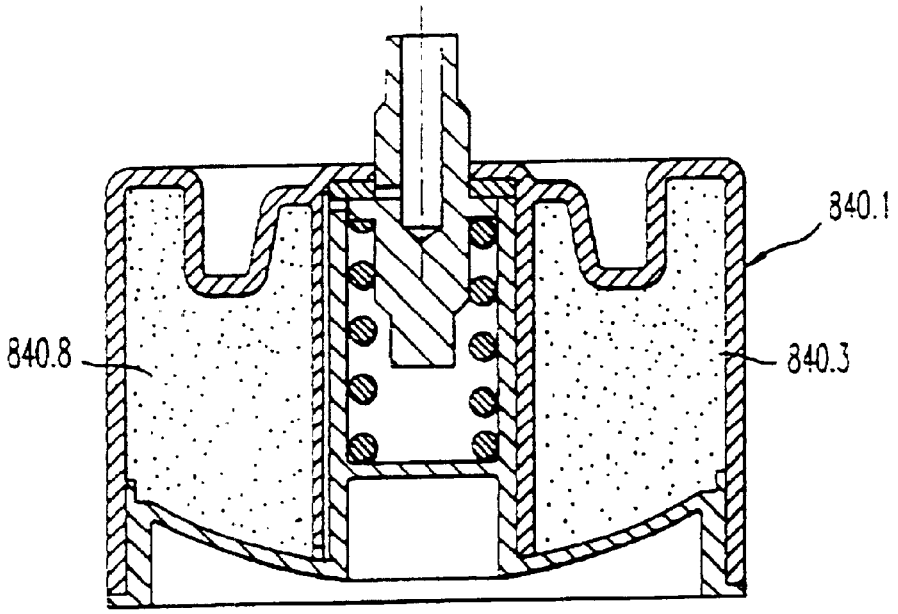
Figure 8C:
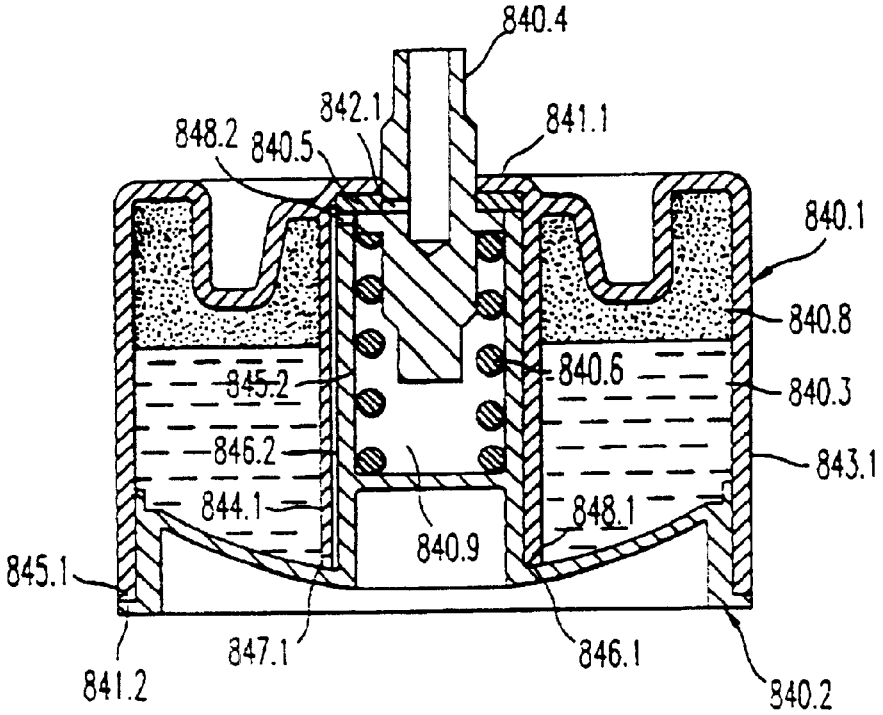
Figure 11A:
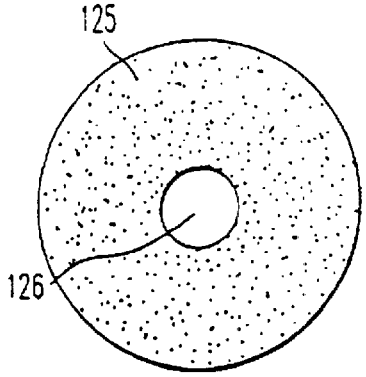
FIGS. 11A and 12A show transverse section views of embodiments of a cylinder of cellular material (before it is inserted into the reservoir cavity)

A pressurized dispenser according to FIGS. 8A to 8C, of cylindrical overall shape is comprised of an upper element 840.1 onto which is fitted a cap (not represented). This upper element interacts with the lower element 840.2 to form, on the one hand, an annular reservoir cavity 840.3 containing a product 840.7 and in which a ring of cellular material 840.8 as represented in FIG. 11 A has been introduced and, on the other hand, the valve cavity 840.9. Inside this there are: an emerging valve-control stem 840.4, a seal 840.5 and a spring 840.6 which, with the lower element, make up a valve. The emerging stem 840.4 is intended to interact with an actuator, such as a push-button, not shown.

Among other things, at the center of its upper plate 841.1, the upper element 840.1 has an orifice 842.1 through which the emerging stem 840.4 passes, an outer skirt 843.1 and an inner skirt 844.1, which are coaxial, the plate 841.1 being orientated substantially at right angles to these skirts.

The outer skirt 843.1 in its lower part has a profile 845.1 capable of accommodating a complementary profile 841.2 coming from the lower element 840.2; these two profiles are welded (FIG. BC).

The inner skirt 844.1 of the upper element has an inside diameter corresponding substantially to that of the seal 840.5 and a height substantially identical to that of the cavity 840.3. The lower surface 846.1 of the inner skirt of the upper element is welded to the bottom of the lower element (FIG. 8C). Situated on the internal periphery of the skirt 844.1 is a chamfer 848.1. A notch 847.1 is furthermore provided in the internal periphery of the bottom of the skirt 844.1; this notch breaks up the continuity of the weld between the internal skirt and the lower element.

The lower element 840.2 on its circumference has the profile 841.2 which complements the one already described 845.1; this profile allows the upper and lower elements to be centered during assembly and is welded to the part 845.1 of the upper element. The lower element has an inner skirt 845.2, the outside diameter of which is substantially equal to the inside diameter of the inner skirt 844.1 of the upper element and these two parts are welded. A groove 846.2 is provided on the outer lateral face of this skirt 845.2, over its entire height, and a notch 848.2 is situated on the upper edge of this skirt.

The assembling of the pressurized dispenser as represented in FIG. 8C is represented in FIGS. 8A and 8B: first of all the spring 840.6 is assembled around the emerging stem 840.4, then the seal 840.5 is placed in the space defined by the inner skirt of the valve body; next, the ring 840.8 and the dished part 840.1 are positioned and the upper element is welded to the lower element 840.2 at the skirt ends. The pressurized dispenser is then filled through the valve: by depressing the emerging stem 840.4, and the product, under pressure, fills the first cavity 840.9 defined by the inner skirt of the valve body, passes through the notch 848.2, runs down along the groove 846.2, via the chamfer 848.1 then via the notch 847.1 and fills the cavity 840.3.

An actuator, such as a push-button, and a cap which are not shown can then be fitted over the emerging stem and onto the upper element respectively.

When the emerging stem is depressed via the push-button, the product follows the reverse path to the one described for filling the device.

Upon injection of the product, the ring is still compressed when the product reaches the orifices 847.1 situated at the bottom of the cavity 840.3, and the ring is pushed back upwards. It follows that the dispenser thus formed can operate in a number of positions. Vertical anti-trapping channels may be provided along the internal wall of the outer skirt 843.1 of the upper element, these channels making it possible to use up the product better.

Shown in FIGS. 9A and 9B, respectively, are a pressurized dispenser and a set of pressurized dispensers including a first container 90*a,* a second dispenser 90*b* and a third dispenser 90*c* which are in accordance with FIG. 1. Of course, this stack may be produced using dispensers from the other figures. The bottom of the valve body 93.2 of the dispenser has a cavity 93.2.4 into which a complementary cylindrical stud 91.1 situated on the cap 91 of another dispenser will fit in order to secure two dispensers together.

For example, the bottom of the valve body 93.2*a,* 93.2*b* of the dispensers represented in FIG. 9B has a cavity 93.2.4*a,* 93.2.4*b* respectively, into which there fits a complementary cylindrical stud 91.1*b,* 91.1*c* respectively situated on the cap 91*b,* 91*c* of another dispenser so as to secure two dispensers together.

Figure 10A:
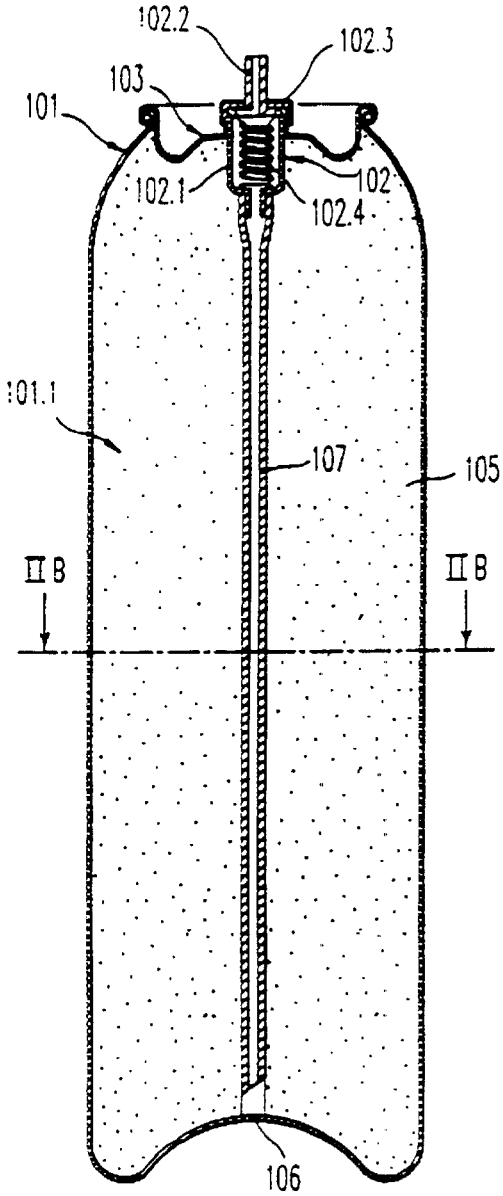
FIGS. 10A and 10B show, in longitudinal section, an embodiment of a dispenser including a cylinder made of closed-cell cellular material that forms propulsion means, and a dip member.
Figure 11B:
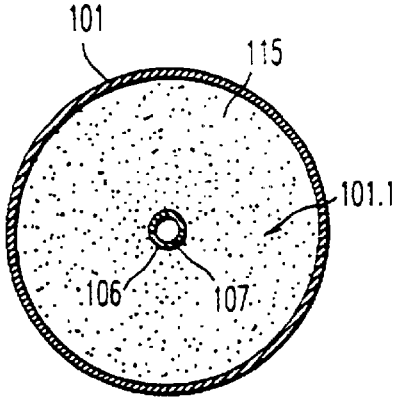

The device represented in FIGS. 10A and 11B includes a dispenser body 101 onto which a cap (not represented) may possibly be fitted; crimped to the neck of this dispenser via a valve-holder dished part 103 is a valve 102; the container body and the dished part define a reservoir cavity 101.1; the valve includes a valve body 102.1, of a valve-control stem 102.2 which passes through the valve body, of a seal 102.3 and of a spring 102.4 which presses the valve-control stem 102.2 against the seal 102.3, the assembly being held in place by the crimping of the valve-holder dished part 103. A dip tube 107 is fixed to the valve. Before the valve 102 is crimped to the container body 101, a cylinder 105 made of Plastazote: a matrix made of polyolefin and nitrogen, was introduced into the cavity 101.1, through the opening in the container body 101.

Visible in FIG. 11 A is the element 125 made of cellular material, of cylindrical shape, including a cylindrical orifice 126 at its center, before it is introduced into the reservoir cavity of the device.

Figure 12A:
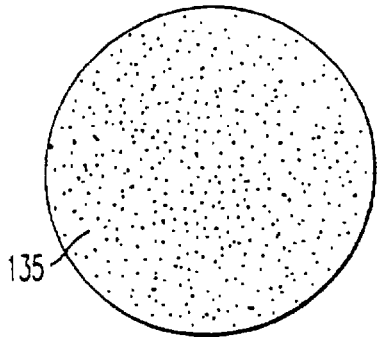

Visible in FIG. 12A is a solid element 135 made of cellular material and of cylindrical shape which can be used in place of the cylinder 125 in a device according to the invention which does not have a dip member.

Visible in FIG. 1 OA is the cylinder 105 made of closed-cell cellular material which has been introduced into the reservoir cavity 101.1 of the container body 101. The outside diameter of the cylinder 105 is designed to be greater than the inside diameter of the container body 101, so as to obtain lateral precompression of the element made of cellular material with the purpose of still having energy available for the last remains of product. A cylindrical central orifice 106 is provided in the cylinder 105, the dip tube 107 being housed in this orifice.

Figure 10B:
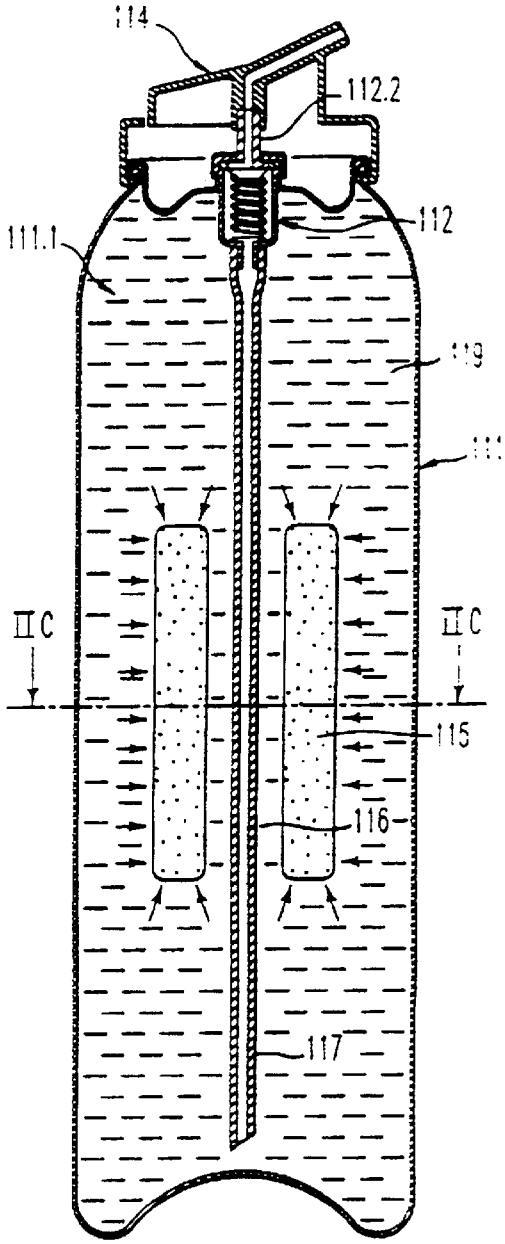

For elements of FIG. 10B which are common with FIG. 10A, the reference of FIG. 10A increased by 10 has been used. For elements of FIG. 11C which are common with FIG. 11B, the reference of FIG. 11B increased by 10 has been used.

Figure 11C:
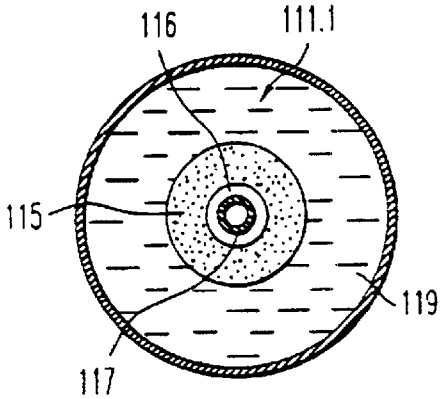

Represented in FIGS. 10B and 11C is a device according to the invention ready for use: this device can be distinguished from that represented in FIGS. 10A and 11B by the fact that a product 119 has been forcibly introduced through the valve 112, and this has led to lateral and longitudinal compression of the cylinder of cellular material 115. The compression is of the hydraulic type, that is to say in three dimensions, throughout the volume of the element made of cellular material 115. The inside diameter of the orifice 116 is therefore slightly increased by comparison with the diameter of the orifice 106 represented in FIG. 10A. The cylinder of cellular material 115 is therefore free to move along the dip tube 117 as a function of its relative density by comparison with the product. Placed on the valve-control stem 112.2 is a push-button 114. By actuating the push-button 114, the valve 112 is opened, the cylinder 115 expands and expels the product 119. When all the product 119 has been expelled from the device, the latter finds itself back in the configuration represented in FIGS. 10A and 11B. This device can be refilled with product 119 as described above. A saving in packaging is thus made, and the problem of reprocessing pressurized devices is considerably reduced because one and the same device can be reused a great many times.

Figure 12B:
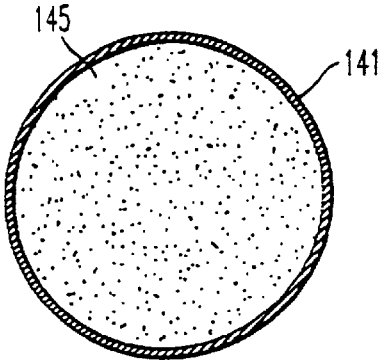
Figure 12C:
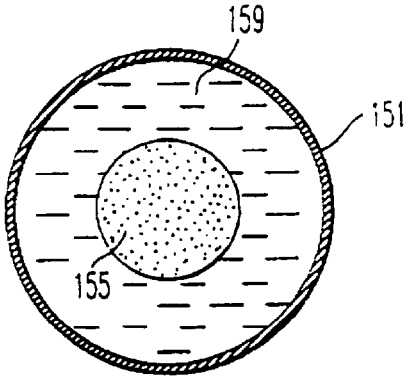

The alternative form of the device according to the present invention represented in FIGS. 12A, 12B and 12C can be distinguished from the device represented in FIGS. 10A. 10B and 11A, 11B and 11C by the absence of a dip tube and of a central orifice in the cylinder of cellular material. Visible in FIG. 12B is the cylinder of cellular material 145 which is placed in the container 141, then in FIG. 12C this same cylinder 155 can be seen compressed hydraulically inside the container 151 into which the product 159 has been introduced.

It will be apparent to those skilled in the art that various modifications and variations can be made to the structure and methodology of the present invention without departing from the scope or spirit of the invention. In view of the foregoing, it is intended that the present invention cover modifications and variations of this invention provided they fall within the scope of the following claims and their equivalents.

What is claimed is:

1. A dispenser for a product, the dispenser comprising:

an upper element;

a lower element, the upper element and the lower element being configured to cooperate together so that both the upper element and the lower element form a reservoir, and a valve cavity;

a product contained in the reservoir; and a valve including the valve cavity formed by the upper and lower elements, an inlet passage for providing flow of the product from the reservoir to the valve, an outlet passage for providing flow of the product from the valve to a dispensing outlet of the dispenser, and a movable valving member configured to be moved from a closed position to an open position to enable flow of the product through the dispensing outlet.

2. The dispenser of claim 1, wherein the product includes at least one pharmaceutical composition.

3. The dispenser of claim 1, wherein the product includes at least one of a vaccine, a hormone, and a drug.

4. The dispenser of claim 1, wherein the product includes at least one vaccine for at least one of flu, rubella, mumps, measles, tuberculosis, tetanus, diphtheria, polio, cholera, plague, rabies, malaria, and leprosy.

5. The dispenser of claim 1, wherein the product includes at least one drug for treating at least one of diabetes, migraine, headache, a lung condition, a bronchial condition, asthma, an allergy, and a cardiovascular condition.

6. The dispenser of claim 1, wherein the product includes at least one antibiotic.

7. The dispenser of claim 1, wherein the product includes at least one sun care product chosen from a sun screen product, a moisturizing product, and an after sun product.

8. The dispenser of claim 1, wherein the product includes at least one cosmetic product.

9. The dispenser of claim 1, wherein the product is a product chosen from shaving foam, shaving gel, hair styling mousse, hair spray, and toothpaste.

10. The dispenser of claim 1, wherein the valve cavity is formed in part by the lower element.

11. The dispenser of claim 10, wherein both the reservoir and the valve cavity are defined in part by the upper element and by the lower element.

12. The dispenser of claim 1, further comprising a movable actuator coupled to the valving member so that actuating movement of the actuator actuates the valving member to the open position.

13. The dispenser of claim 1, wherein the valve further includes a biasing member biasing the valving member toward the closed position.

14. The dispenser of claim 1, wherein the valve further comprises a seal cooperating with the valving member to prevent flow of the product from the valve when the valving member is in the closed position.

15. The dispenser of claim 1, further comprising an orifice for filling the reservoir and a valve element for the orifice.

16. The dispenser of claim 1, wherein the product in the reservoir is pressurized.

17. The dispenser of claim 1, further comprising a gas pressurizing the product, the gas being arranged in an arrangement chosen from an arrangement wherein the gas is separated from the product and an arrangement wherein the gas is in contact with the product.

18. The dispenser of claim 1, wherein the upper element and the lower element are made of thermoplastic material.

19. The dispenser of claim 1, wherein the upper element and the lower element are made of a material chosen from a polyolefin, a polyacetyl, polyethylene terephthalate, polymethylmethacrylate, and polybutylene terephthalate.

20. The dispenser of claim 1, further comprising one of a nozzle, a mesh, and a porous dome disposed in a flow path for the product.

21. The dispenser of claim 1, wherein the reservoir has a volume ranging from about 3.5 ml to about 8 ml.

22. The dispenser of claim 1, wherein the reservoir has a generally annular shape and wherein the reservoir surrounds the valve cavity.

23. The dispenser of claim 22, wherein the generally annular shape of the reservoir extends from a bottom end of the reservoir to a top end of the reservoir.

24. The dispenser of claim 1, wherein the upper element defines a top end of the valve cavity and wherein the lower element defines a bottom end of the valve cavity.

25. The dispenser of claim 24, wherein the valve further comprises a biasing member biasing the valving member toward the closed position, wherein the biasing member contacts a portion of the lower element defining the bottom end of the valve cavity.

26. The dispenser of claim 24, wherein the upper element defines a top end of the reservoir and wherein the lower element defines a bottom end of the reservoir.

27. The dispenser of claim 1, wherein the upper element defines a top end of the reservoir and wherein the lower element defines a bottom end of the reservoir.

28. The dispenser of claim 1, further comprising an element made of closed-cell cellular material, the cellular material element being located in the reservoir and applying pressure to the product.

29. A dispenser for a product, the dispenser comprising:

a dispensing outlet on an upper portion of the dispenser, an upper element;

a lower element, the upper element and the lower element both defining a reservoir;

a product contained in the reservoir; and a valve including a movable valving member configured to be moved from a closed position to an open position to enable flow of the product through the dispensing outlet, and a biasing member biasing the valving member toward the closed position, the biasing member being in contact with the lower element.

30. The dispenser of claim 29, wherein the product includes at least one pharmaceutical composition.

31. The dispenser of claim 29, wherein the product includes at least one of a vaccine, a hormone, and a drug.

32. The dispenser of claim 29, wherein the product includes at least one vaccine for at least one of flu, rubella, mumps, measles, tuberculosis, tetanus, diphtheria, polio, cholera, plague, rabies, malaria, and leprosy.

33. The dispenser of claim 29, wherein the product includes at least one drug for treating at least one of diabetes, migraine, headache, a lung condition, a bronchial condition, asthma, an allergy, and a cardiovascular condition.

34. The dispenser of claim 29, wherein the product includes at least one antibiotic.

35. The dispenser of claim 29, wherein the product includes at least one sun care product chosen from a sun screen product, a moisturizing product, and an after sun product.

36. The dispenser of claim 29, wherein the product includes at least one cosmetic product.

37. The dispenser of claim 29, wherein the product is a product chosen from shaving foam, shaving gel, hair styling mousse, hair spray, and toothpaste.

38. The dispenser of claim 29, wherein the biasing member biases the valving member toward the upper portion of the dispenser.

39. The dispenser of claim 29, wherein the valve includes a valve cavity having a bottom end defined by the lower element, and wherein the biasing member contacts a portion of the lower element defining the bottom end.

40. The dispenser of claim 29, further comprising a movable actuator coupled to the valving member so that actuating movement of the actuator actuates the valving member to the open position.

41. The dispenser of claim 29, wherein the valve further comprises a seal cooperating with the valving member to prevent flow of the product from the valve when the valving member is in the closed position.

42. The dispenser of claim 29, wherein the product in the reservoir is pressurized.

43. The dispenser of claim 29, wherein the reservoir has a generally annular shape extending from a bottom end of the reservoir to a top end of the reservoir.

44. The dispenser of claim 29, wherein the upper element defines a top end of the reservoir and wherein the lower element defines a bottom end of the reservoir.

45. A dispenser for a product, the dispenser comprising:

a reservoir;

a product contained in the reservoir; and a valve including a valve cavity, an inlet passage in fluid communication with the reservoir, the inlet passage having a first end in fluid communication with the valve cavity and a second end in a vicinity of a bottom of the reservoir, the inlet passage extending outside of the valve cavity along at least a part of the length of the valve cavity, an outlet passage for providing flow of the product from the valve to a dispensing outlet of the dispenser, and a movable valving member configured to be moved from a closed position to an open position to enable flow of the product through the dispensing outlet.

46. The dispenser of claim 45, wherein the product includes at least one pharmaceutical composition.

47. The dispenser of claim 45, wherein the product includes at least one of a vaccine, a hormone, and a drug.

48. The dispenser of claim 45, wherein the product includes at least one vaccine for at least one of flu, rubella, mumps, measles, tuberculosis, tetanus, diphtheria, polio, cholera, plague, rabies, malaria, and leprosy.

49. The dispenser of claim 45, wherein the product includes at least one drug for treating at least one of diabetes, migraine, headache, a lung condition, a bronchial condition, asthma, an allergy, and a cardiovascular condition.

50. The dispenser of claim 45, wherein the product includes at least one antibiotic.

51. The dispenser of claim 45, wherein the product includes at least one sun care product chosen from a sun screen product, a moisturizing product, and an after sun product.

52. The dispenser of claim 45, wherein the product includes at least one cosmetic product.

53. The dispenser of claim 45, wherein the product is a product chosen from shaving foam, shaving gel, hair styling mousse, hair spray, and toothpaste.

54. The dispenser of claim 45, further comprising a movable actuator coupled to the valving member so that actuating movement of the actuator actuates the valving member to the open position.

55. The dispenser of claim 45, wherein the valve further comprises a biasing member and a seal cooperating with the valving member to prevent flow of the product from the valve when the valving member is in the closed position.

56. The dispenser of claim 45, wherein the product in the reservoir is pressurized.

57. The dispenser of claim 45, wherein the reservoir has a generally annular shape extending from a bottom end of the reservoir to a top end of the reservoir.

58. The dispenser of claim 45, further comprising an upper element and a lower element cooperating to define both the reservoir and the valve cavity.

59. A dispenser for a product, the dispenser comprising:

a container body including at least one inner wall and an outer wall defining a reservoir having a generally annular shape extending from a bottom end of the reservoir to a top end of the reservoir;

a product contained in the reservoir; and a valve including a valve cavity located in the container body such that the generally annular reservoir surrounds the valve cavity and a top end of the valve cavity is in a vicinity of the top end of the reservoir, an inlet passage for providing flow of the product from the reservoir to the valve, an outlet passage for providing flow of the product from the valve to a dispensing outlet of the dispenser, and a movable valving member configured to be moved from a closed position to an open position to enable flow of the product through the dispensing outlet.

60. The dispenser of claim 59, wherein the product includes at least one pharmaceutical composition.

61. The dispenser of claim 59, wherein the product includes at least one of a vaccine, a hormone, and a drug.

62. The dispenser of claim 59, wherein the product includes at least one vaccine for at least one of flu, rubella, mumps, measles, tuberculosis, tetanus, diphtheria, polio, cholera, plague, rabies, malaria, and leprosy.

63. The dispenser of claim 59, wherein the product includes at least one drug for treating at least one of diabetes, migraine, headache, a lung condition, a bronchial condition, asthma, an allergy, and a cardiovascular condition.

64. The dispenser of claim 59, wherein the product includes at least one antibiotic.

65. The dispenser of claim 59, wherein the product includes at least one sun care product chosen from a sun screen product, a moisturizing product, and an after sun product.

66. The dispenser of claim 59, wherein the product includes at least one cosmetic product.

67. The dispenser of claim 59, wherein the product is a product chosen from shaving foam, shaving gel, hair styling mousse, hair spray, and toothpaste.

68. The dispenser of claim 59, wherein the top end of the reservoir and the top end of the valve cavity are at substantially the same level.

69. The dispenser of claim 59, wherein the container body comprises an upper element having a top portion defining both the top end of the reservoir and the top end of the valve cavity.

70. The dispenser of claim 59, wherein the container body comprises a lower element having a bottom portion defining both a bottom end of the reservoir and a bottom end of the valve cavity.

71. The dispenser of claim 59, comprising a movable actuator coupled to the valving member so that actuating movement of the actuator actuates the valving member to the open position.

72. The dispenser of claim 59, wherein the valve further comprises a biasing member and a seal cooperating with the valving member to prevent flow of the product from the valve when the valving member is in the closed position.

73. The dispenser of claim 59, wherein the product in the reservoir is pressurized.

74. The dispenser of claim 59, wherein the container body comprises an upper element and a lower element cooperating to define both the reservoir and the valve cavity.

75. A dispenser for a product, the dispenser comprising:

a dispensing outlet on an upper portion of the dispenser;

a container body defining a reservoir, the container body including an element defining both a bottom end portion of the reservoir, and a bottom end portion of a valve cavity;

a product contained in the reservoir; and a valve including the valve cavity having the bottom portion defined by the element, an inlet passage for providing flow of the product from the reservoir to the valve, an outlet passage for providing flow of the product from the valve to the dispensing outlet, and a movable valving member configured to be moved from a closed position to an open position to enable flow of the product through the dispensing outlet.

76. The dispenser of claim 75, wherein the product includes at least one pharmaceutical composition.

77. The dispenser of claim 75, wherein the product includes at least one of a vaccine, a hormone, and a drug.

78. The dispenser of claim 75, wherein the product includes at least one vaccine for at least one of flu, rubella, mumps, measles, tuberculosis, tetanus, diphtheria, polio, cholera, plague, rabies, malaria, and leprosy.

79. The dispenser of claim 75, wherein the product includes at least one drug for treating at least one of diabetes, migraine, headache, a lung condition, a bronchial condition, asthma, an allergy, and a cardiovascular condition.

80. The dispenser of claim 75, wherein the product includes at least one antibiotic.

81. The dispenser of claim 75, wherein the product includes at least one sun care product chosen from a sun screen product, a moisturizing product, and an after sun product.

82. The dispenser of claim 75, wherein the product includes at least one cosmetic product.

83. The dispenser of claim 75, wherein the product is a product chosen from shaving foam, shaving gel, hair styling mousse, hair spray, and toothpaste.

84. The dispenser of claim 75, wherein the element defining the bottom end portions of the reservoir and the valve cavity is a lower element, and wherein the container body further comprises an upper element defining both a top end portion of the reservoir and a top end portion of the valve cavity.

85. The dispenser of claim 75, wherein the element further defines a side portion of the valve cavity.

86. The dispenser of claim 75, wherein the element includes an axially oriented annular wall defining the side portion of the valve cavity.

87. The dispenser of claim 75, wherein the element includes a wall having a first side defining the bottom end portion of the valve cavity and a second opposite facing side defining an exterior bottom surface of the dispenser.

88. The dispenser of claim 75, wherein the valve further comprises a biasing member biasing the valving member toward the closed position.

89. The dispenser of claim 75, wherein the biasing member is in contact with the element and biases the valving member away from the bottom end portion of the valve cavity.

90. The dispenser of claim 75, further comprising a movable actuator coupled to the valving member so that actuating movement of the actuator actuates the valving member to the open position.

91. The dispenser of claim 75, wherein the valve further includes a seal cooperating with the valving member to prevent flow of the product from the valve when the valving member is in the closed position.

92. The dispenser of claim 75, wherein the product in the reservoir is pressurized.

93. The dispenser of claim 75, wherein the reservoir has a generally annular shape and wherein the reservoir surrounds the valve cavity.

94. A method of dispensing a product, comprising:

providing the dispenser of claim 1;

moving the valving member to the open position to dispense product from the dispenser; and directing the dispensed product toward a portion of an individual.

95. The method of claim 94, wherein the portion of the individual includes at least one of the mouth, the nose, the skin, and the hair.

96. The method of claim 94, wherein the product includes at least one of a cosmetic product, a vaccine, a hormone, and a drug.

97. A method of dispensing a product, comprising:

providing the dispenser of claim 29;

moving the valving member to the open position to dispense product from the dispenser; and directing the dispensed product toward a portion of an individual.

98. The method of claim 97, wherein the portion of the individual includes at least one of the mouth, the nose, the skin, and the hair.

99. The method of claim 97, wherein the product includes at least one of a cosmetic product, a vaccine, a hormone, and a drug.

100. A method of dispensing a product, comprising:

providing the dispenser of claim 45;

moving the valving member to the open position to dispense product from the dispenser, and directing the dispensed product toward a portion of an individual.

101. The method of claim 100, wherein the portion of the individual includes at least one of the mouth, the nose, the skin, and the hair.

102. The method of claim 100, wherein the product includes at least one of a cosmetic product, a vaccine, a hormone, and a drug.

103. A method of dispensing a product, comprising:

providing the dispenser of claim 59;

moving the valving member to the open position to dispense product from the dispenser; and directing the dispensed product toward a portion of an individual.

104. The method of claim 103, wherein the portion of the individual includes at least one of the mouth, the nose, the skin, and the hair.

105. The method of claim 103, wherein the product includes at least one of a cosmetic product, a vaccine, a hormone, and a drug.

106. A method of dispensing a product, comprising:

providing the dispenser of claim 75;

moving the valving member to the open position to dispense product from the dispenser; and directing the dispensed product toward a portion of an individual.

107. The method of claim 106, wherein the portion of the individual includes at least one of the mouth, the nose, the skin, and the hair.

108. The method of claim 106, wherein the product includes at least one of a cosmetic product, a vaccine, a hormone, and a drug.

* * * * *

UNITED STATES PATENT AND TRADEMARK OFFICE

CERTIFICATE OF CORRECTION

PATENT NO. : 6,464,111 B2
DATED : October 15, 2002
INVENTOR(S) : Vincent De LaForcade et al.

It is certified that error appears in the above-identified patent and that said Letters Patent is hereby corrected as shown below:

Column 18,
Line 6, please change “dispenser,” to -- dispenser; --.

Column 21,
Line 29, please change “opposite facing” to -- opposite-facing --.

Column 22,
Line 22, please change “dispenser,” to -- dispenser; --.

Signed and Sealed this

Eleventh Day of February, 2003

JAMES E. ROGAN
*Director of the United States Patent and Trademark Office*